US008381920B2

(12) United States Patent
Chang

(10) Patent No.: US 8,381,920 B2
(45) Date of Patent: Feb. 26, 2013

(54) COLLAPSE STRUCTURE OF TOOL HANGER BOARD

(76) Inventor: Chi-Tsai Chang, Taichung (TW)

( * ) Notice: Subject to any disclaimer, the term of this patent is extended or adjusted under 35 U.S.C. 154(b) by 200 days.

(21) Appl. No.: 12/906,154

(22) Filed: Oct. 18, 2010

(65) Prior Publication Data

US 2012/0091082 A1 Apr. 19, 2012

(51) Int. Cl.
*A47F 7/00* (2006.01)

(52) U.S. Cl. ..... 211/70.6; 211/113

(58) Field of Classification Search ..... 211/70.6, 211/4, 60.1, 69, 69.1, 113, 118; 206/349, 206/376, 461, 495, 806, 807; 248/309.1, 248/314, 316.1

See application file for complete search history.

(56) References Cited

U.S. PATENT DOCUMENTS

| | | | | | |
|---|---|---|---|---|---|
| 3,758,060 | A * | 9/1973 | Schuplin | 248/74.3 |
| 3,949,872 | A * | 4/1976 | Paudras | 206/310 |
| 4,872,551 | A * | 10/1989 | Theros | 206/349 |
| 5,322,162 | A * | 6/1994 | Melk | 206/310 |
| 5,435,447 | A * | 7/1995 | Weatherford et al. | 206/349 |
| 5,595,295 | A * | 1/1997 | Lin | 206/349 |
| 5,713,467 | A * | 2/1998 | Kao | 206/349 |
| 5,906,350 | A * | 5/1999 | Kao | 248/688 |
| 5,996,817 | A * | 12/1999 | Kao | 211/70.6 |
| 6,360,892 | B1 * | 3/2002 | Chen | 206/376 |
| 6,401,923 | B1 * | 6/2002 | Huang | 206/376 |
| 6,837,373 | B2 * | 1/2005 | Huang | 206/376 |
| 6,874,629 | B1 * | 4/2005 | Wortrich | 206/349 |
| 6,896,136 | B2 * | 5/2005 | Hu | 206/378 |
| 7,428,969 | B2 * | 9/2008 | Wu | 206/349 |
| 2004/0000497 | A1 * | 1/2004 | Huang | 206/376 |
| 2004/0035731 | A1 * | 2/2004 | Lee | 206/349 |
| 2004/0217029 | A1 * | 11/2004 | Ho | 206/370 |
| 2005/0133389 | A1 * | 6/2005 | Baublitz et al. | 206/303 |
| 2007/0007156 | A1 * | 1/2007 | Wu | 206/376 |

* cited by examiner

*Primary Examiner* — Jennifer E Novosad
*Assistant Examiner* — Hiwot Tefera
(74) *Attorney, Agent, or Firm* — Muncy, Geissler, Olds & Lowe, PLLC

(57) ABSTRACT

A simple collapse structure of tool hanger board is provided, especially for reducing package volume of the hanger with a tool inserted therein. The hanger board has a hanger board body that functions to hang a tool for exhibition. The hanger board body has a lower portion that forms an insertion slot for receiving insertion and positioning of a tool therein. With a retention plate projecting from the body for securely looping and fixing the tool, secure insertion of the tool can be realized. An upper portion of the body that is located above a central positioning bar is made as a pivotally connected foldable upper board section. The upper board section is folded downward to overlap a rear surface of the board body so as to reduce the overall length of the hanger and thus effectively reduce the package volume, facilitate handling and lower costs of packaging and shipping.

4 Claims, 3 Drawing Sheets

COLLAPSE STRUCTURE OF TOOL HANGER BOARD

TECHNICAL FIELD OF THE INVENTION

The present invention generally relates to a simple collapse structure of too hanger board, which allows a hanger board, when used to hang a regular tool, to be properly folded so that the package volume of the hanger structure can be significantly reduced, thereby realizing the practical purposes of substantially reducing overall cost for hanging package and shipping package of tools.

DESCRIPTION OF THE PRIOR ART

An ordinary hand tool is often packaged in the form of simple hanging structure for ready exhibition or display, especially for a hand tool of a slender form, such as a spanner and a screwdriver. To pack the tool, since the configuration of the tool is slender and elongate and also due to the need for secure and anti-theft protection, a thick card board having a sufficient width and an extended length is often used to make a hanger for the tool and a shell enclosure is set on the card board to completely cover the tool positioned on a front surface of the card board. The enclosure shell is made in advance with blow molding of a transparent material. With the tool to be displayed positioned therein, the enclosure shell is adhered to the card board to enclose the tool therebetween. Most of the general consumers, who love to do household maintenance by themselves, are not skilled technicians and they have to actually hold or grip a hand tool for inspection purposes before they purchase the tool. The conventional shell enclosure makes inspection of this way difficult, making it a barrier for the general consumers to purchase the tool. Further, since the card board based package is often made to completely enclose the whole tool, when the tool so packaged has a long handle, the package volume is significantly increased and handling and hanging of the tool turn out to be difficult. Thus, a lot of tools that are of a slender and elongate configuration are often only fixed at a head portion thereof. Taking a regular adjustable spanner as an example, the adjustable spanner is a slender and elongate tool, which is designated at 30 in FIG. 5 of the attached drawings. Packaging of such a tool is made with a hanger board 31 made of an elongate member having a sufficient width, serving a main body of packaging and hanging the tool 30. The hanger board 31 has a top portion forming a hanging hole 32 for purposes of hanging and exhibition. A central portion of the hanger board forms a through hole 33 for positioning and retaining a head portion of the tool 30 by sandwiching the tool with female and male snap fasteners 34, 35. The female snap fastener 35 is set through the hanger board 31 from a front side thereof where the tool 30 is positioned to a rear side of the board, and then the male snap fastener 34 is fit into the female snap fastener 35 to couple to each other. The female snap fastener 35 has an expanded outer circumferential flange, serving as a holding plate 36 that covers and holds the head portion of the tool 30 to prevent the tool from falling or detaching. A lower portion of the hanger board 31 forms an arc slot 37 that slidably receives therein a U-shaped retention frame 38 that holds an extended handle of the tool 30 in such a way that the tool handle is rotatable for sideway swinging, allowing for inspection of the tool in a hung condition without any risk of falling. This achieves a secure hanging arrangement for tool 30. Although such an arrangement of hanger board 31 allows for ready selection and inspection of the tool 30, yet the total length of the tool and the extension length of the hanger board 31 together increases the package volume significantly, which in turn leads to an increase of packaging cost, and adding trouble to handling. Thus, it is desired to further improve the existing hanger board structure in order to make the hanger board based package meeting the practical needs of hanging exhibition of tool in respect of economics and handling convenience.

SUMMARY OF THE INVENTION

In view of the troubles in relation to packaging and handling resulting from package volume being hard to reduce for slender tools, the present invention aims to provide a simple collapse structure of too hanger board, wherein an upper board section above the portion of a hanger board body where a tool is inserted and retained is arranged in a foldable form in order to overcome the drawbacks and wastes resulting from high costs and uneconomic applications caused by excessively large package volume of a conventional hanger board that is of large width and extended length.

An objective of the present invention is to make an upper board section of a hanger board in a simple foldable and positionable arrangement, whereby when a tool is inserted and packaged, the package volume is significantly reduced to achieve practical and economic purposes of reducing the package volume and the associated costs, and also achieving a secondary purpose of secure protection of the package made on the hanger board.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
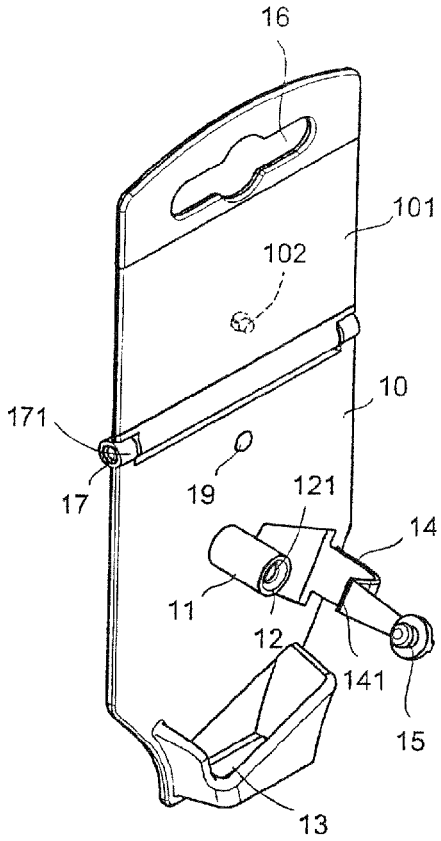
FIG. 1 is a perspective view showing a hanger board according to the present invention.
Figure 2:
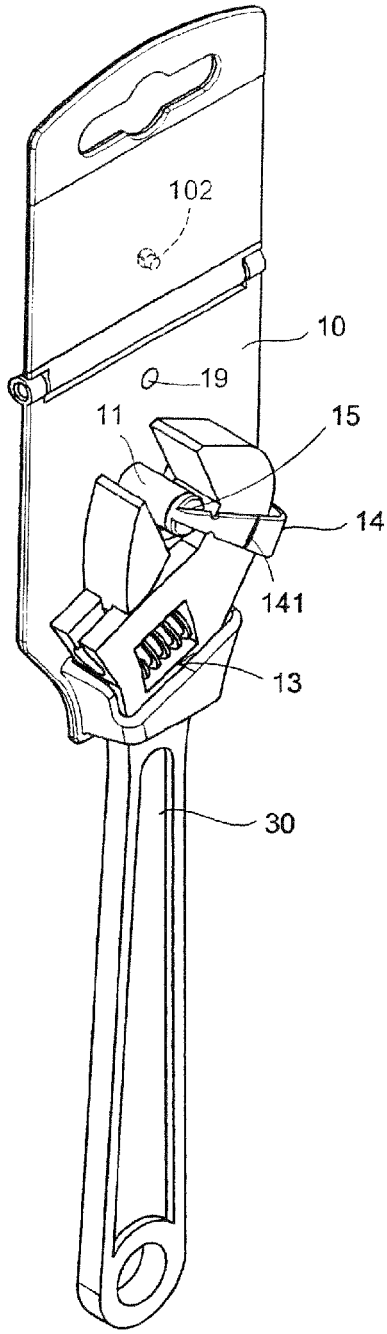
FIG. 2 is a perspective view showing an application of the hanger board of the present invention.
Figure 3:
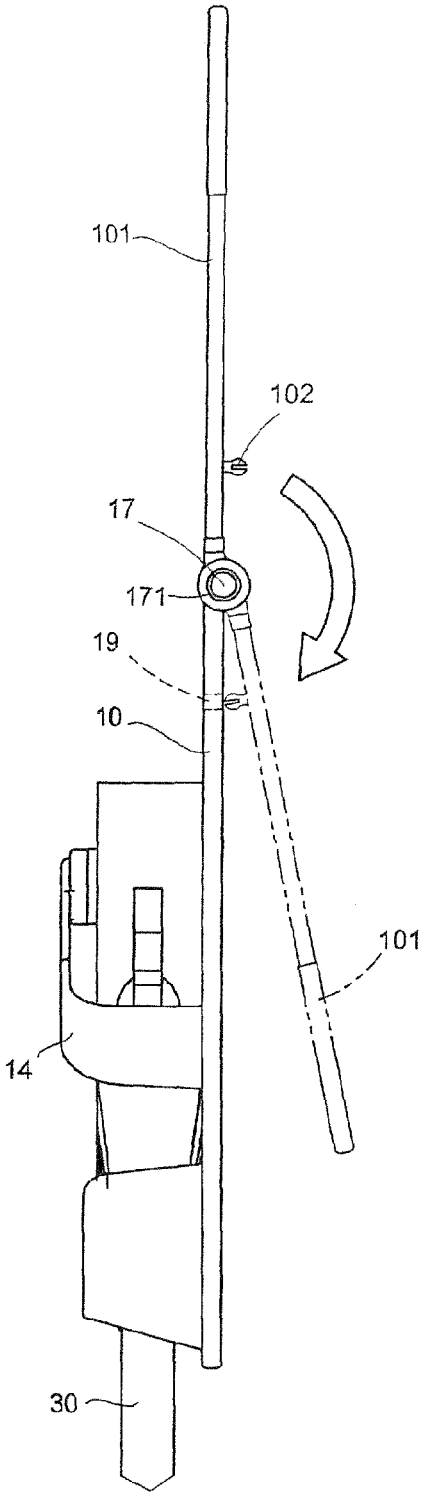
FIG. 3 is a side elevational view showing a foldable arrangement of the hanger board of the present invention.
Figure 4:
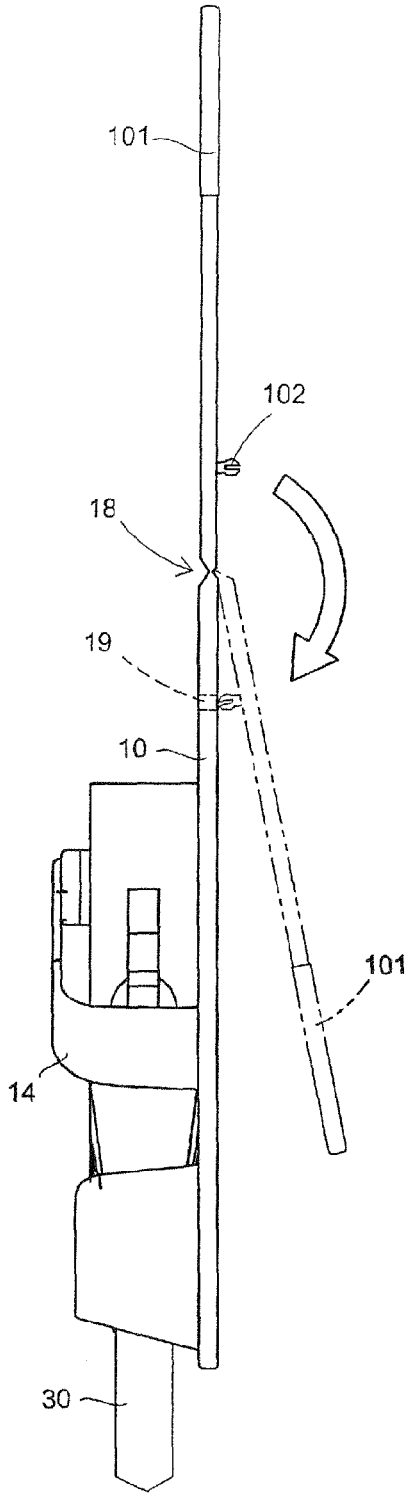
FIG. 4 is a side elevational view showing another foldable arrangement of the hanger board of the present invention.
Figure 5:
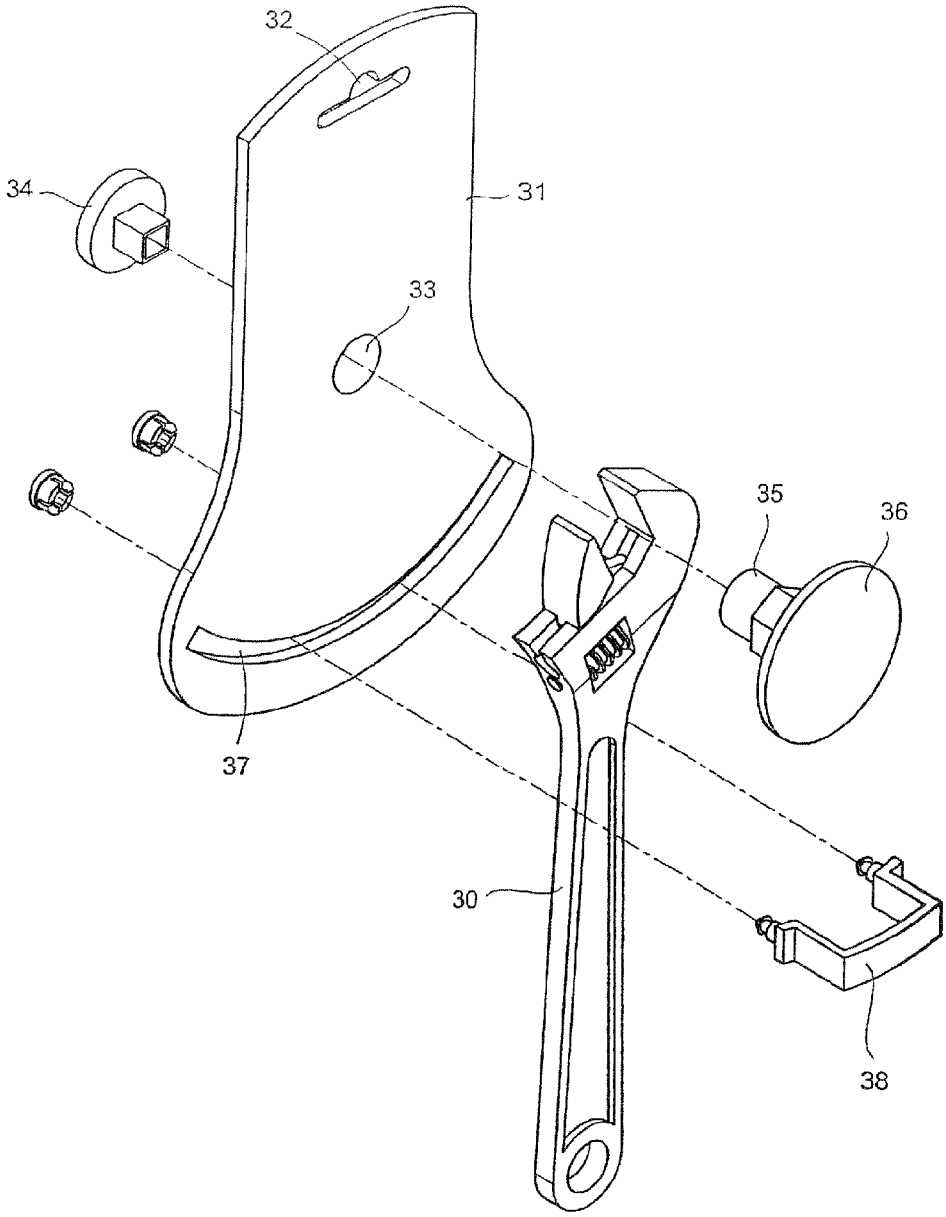
FIG.5 PRIOR ART
FIG. 5 is an exploded view showing a conventional hanger board used to hang a tool.

The present invention provides a collapse structure of tool hanger board, which is particularly shown in FIGS. 1-4 of the attached drawings. The hanger comprises, in construction, a hanger board body 10 that serves as a main portion for hanging purposes and is in the form of an elongate board. The board comprises a raised positioning bar 11 mounted to and projecting from a central portion of the board. The bar may alternatively be arranged in a releasable coupling form. The bar has a projecting body made in a tubular form having a central through hole 12. Alternatively, the bar forms an insertion cavity that is recessed in a projecting free end of the bar by a predetermined depth. The hanger board body 10 has a lower portion on which an insertion slot 13 that functions for ready insertion and positioning of a tool 30 is formed in an enclosing frame projecting from the board. Formed on one side portion of the body 10 or a side wall of the enclosing frame of the insertion slot 13 is a retention plate 14 integrally extending therefrom and thus having an extension end that forms a projecting insertion fastener 15. The through hole 12 that is provided in the bar 11 for insertion purposes is formed as a stepped bore or has a circumferential engagement groove 121 formed by recessing an inside wall of the hole at a predetermined depth for easy insertion and fixing of an end rim projecting from the insertion fastener 15 therein, whereby security and convenience of fixing are realized through such an easy insertion after the tool 30 has been put therein. Further, the retention plate 14 forms, at a predetermined location of an intermediate section thereof, an indented and thus thinned fold line 141 that extends across the surface of the plate for the purposes of readily bending or flexing, whereby a portion of the retention plate that comprises the insertion fastener 15 of the extension end is readily outward deflectable to form a wide insertion opening that allows for easy insertion and positioning of the tool 30 therein. Thus, with the insertion fastener 15 of the retention board 14 being inserted into the central through hole 12 of the bar 11 to form insert-to-fix packaging, a tool 30, when hung for exhibition, can be hung and displayed in a securely looped and covered manner. Further, except a top end portion in which an elongate slot 16 for hanging purposes is formed, the whole board of the hanger board body 10 is divided into an upper board half and a lower board half, which are connected to each other in a pivotal arrangement that is set at a predetermined location above the bar 11. In other words, the portion of the board above the bar 11 is constructed to form a foldable upper board section 101, of which a lower edge forms two holed seats 171 at opposite ends thereof for rotatably coupling a pivot pin 17, whereby the upper board section 101 of the hanger board body 10 is rotatable for being folded to overlap a back surface of the hanger board body 10. This significantly reduces packaging volume of the hanger board body 10. Further to allow the rotatably folded upper board section 101 to be fixed to the body 10, a snap-on peg 102 is formed on and projecting from an intermediate portion of back surface of the upper board section 101, and the body 10 also forms a recessed or through cavity 19 on a surface thereof at a corresponding site for mutual engagement that realizes positioning and fixing. The projecting and recesses features can be interchanged with each other and this is considered equivalent to the embodiment of the present invention mentioned above. Thus, the board that is stored in an overlapped form can provide a stiff reinforcement for a package of the packed hanger and ensure delicate and secure packing of the hanger.

The folded storage arrangement of the hanger board body 10 according to the present invention significantly reduces the package volume of the whole hanger board structure, achieving an effect of secure us in relation to efficacies of delicate packaging and easy and convenient shipping. Besides the pivotal connection discussed above, the folding arrangement of the board can be realized through an indent and thinned connection fold line 18 that is formed at the pivotal connection site of an intermediate portion of the board through a molding or otherwise manufacturing process. Such a fold line based connection arrangement, together with the auxiliary positioning structure formed by the mateable snap-on peg 102 and snap-on cavity 19, allows the upper board section 101 to be readily folded to overlap the back surface of the hanger board body 10 during a packaging process and similar result of reducing package volume can be realized. Through such a ready board folding operation, the whole package volume is significantly reduced, and at the same time a practical secure effect for hanging exhibition can also be achieved, whereby the costs for packaging and shipping can be reduced and an economic use that ensures both security and hanging exhibition is provided.

In summary, the present invention provides a collapse structure of tool hanger board, wherein an upper board section is arranged in a foldable form for overlapping the board to thereby effectively reduce the package volume and to provide an economic and secured use for a hanging package structure of tool.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A collapsible structure of tool hanger board comprising a hanger board in the form of an elongate board, an insertion slot formed by an enclosing frame raised from the board, and a positioning bar extending from a central portion of surface of the board, characterized in that the hanger board has a body comprising an upper board section located above the positioning bar and pivotally connected to the hanger board body, whereby the upper board section is foldable to overlap a back surface of the hanger board in a packaging process in order to realize packaging security and reduction of package volume, the upper board section has a back surface comprising a snap-on peg projecting from an intermediate section thereof and the body has a surface forming a through cavity at a location corresponding to the snap-on peg, the snap-on peg and the cavity being mateable with each other for fixing and positioning the upper board section, the snap-on peg includes a body portion projecting from the back surface of the upper board section and an enlarged head portion integrally formed on the body portion and having an indentation, whereby the upper board section is permitted to be releasably secured to the back surface of the hanger board, a retention plate integrally extends from the hanger board body and has an extension end that forms a projecting insertion fastener, the insertion fastener is selectively inserted into a central through hole of the positioning bar, and the positioning bar is substantially unbendable when a tool is inserted in the insertion slot.

2. The collapsible structure of tool hanger board according to claim 1, wherein the pivotal connection between the upper board section and the hanger board body comprises holed seats and a pivot pin.

3. The collapsible structure of tool hanger board according to claim 1, wherein the pivotal connection between the upper board section and the hanger board body comprises an indented and thinned fold line.

4. The collapsible structure of tool hanger board according to claim 1, wherein the snap-on peg of the back surface of the upper board section and the cavity of the surface of the body are interchangeable with each other.

* * * * *